United States Patent [19]

Warburton et al.

[11] 3,999,255

[45] Dec. 28, 1976

[54] MANUFACTURE OF SLIDING CLASP FASTENERS

[75] Inventors: Geoffrey Warburton, Cyncoed; Glanffrwd Morgan, Rhondda, both of England

[73] Assignee: Textron, Inc., Providence, R.I.

[22] Filed: Mar. 9, 1976

[21] Appl. No.: 665,352

[30] Foreign Application Priority Data

Mar. 13, 1975 United Kingdom ..... 10435/75

[52] U.S. Cl. ..... 24/205 R; 24/205.11 F; 24/205.16 D; 156/66; 156/73.1; 156/250; 264/23; 264/249

[51] Int. Cl.[2] ..... B32B 31/20

[58] Field of Search ..... 156/66, 73.1, 250; 24/205.16 D, 205 R, 205.11 F; 264/23, 249, 69

[56] References Cited

UNITED STATES PATENTS

| | | | |
|---|---|---|---|
| 3,001,904 | 9/1961 | Porepp | 24/205.11 F |
| 3,948,705 | 4/1976 | Ausnit | 156/66 |

*Primary Examiner*—Edward G. Whitby
*Attorney, Agent, or Firm*—O'Brien & Marks

[57] ABSTRACT

There is disclosed a method of producing sealed end stringers for sliding clasp fasteners from a pair of stringer tapes, each of which is provided on one of its edges with a row of fastening elements. The tapes are first arranged so that the two rows of fastening elements face each other, and then a plurality of spaced apart pairs of strands of plastics material, which are disposed to extend transversely of the tapes, are welded to the tapes so that the tapes are connected together by the strands. The strands are severed in the region between the tapes, and a plurality of guide members of plastics material are formed on the tape edges having the rows of fastening elements, each of the guide members being connected to a respective one of the severed portions of alternate ones of the strands to extend away from the respectively adjacent one of the other strands. The tapes can then be severed between the strands of each pair so as to provide completed stringer pairs with ends sealed by the welded strands. One stringer of each such pair of stringers can be fitted with a slider and — on its guide member — with an open end box member receiving the guide member of the other stringer of the respective pair. The strand portions at the ends of the stringers remote from the guide members can be suitably adapted to limit travel of the slider along the stringers.

14 Claims, 3 Drawing Figures

MANUFACTURE OF SLIDING CLASP FASTENERS

BACKGROUND OF THE INVENTION

The present invention relates to the manufacture of sliding clasp fasteners, and in particular to the production of sealed end stringers for sliding clasp fasteners from a pair of stringer tapes each provided on one edge thereof with a row of fastening elements.

In a conventional sliding clasp fastener, the stringers comprise two flexible tapes respectively provided with two rows of interengageable fastening elements, which may, for example, be formed from appropriately shaped continuous filaments of plastics material, the filaments being sewn to the tapes. The fastener is operated in a known manner by a slider movable along the rows of fastening elements between stop means at either end of the fastener.

In the case of a fastener which in use must permit the two stringers to be completely separated, one of the stringers, to which the slider is permanently attached, is provided at one end with an open end box member, and the other stringer is provided with a guide member insertable through alignable slots in the slider and box member to effect an initial connection of the stringers.

The provision of the stop means and guide member, and the securing of the tape ends against fraying, may entail different manufacturing procedures and materials, which increases the cost of the finished fastener.

The invention therefore has as one of its objects the provision of a method for producing finished stringers for sliding clasp fasteners in a series of steps of a single manufacturing process, without recourse to distinctly different processes and materials.

A further object of the invention is to provide a method as mentioned above in which the steps are carried out in relation to continuous tape lengths for a plurality of fasteners, rather than in relation to tape lengths for individual fasteners, so as to correspondingly simplify handling of materials and manufacturing operations.

A further object of the invention is to provide a method of the kind described in which plastics materials may be utilized both to seal the ends of the stringers and to furnish the requisite end fittings.

SUMMARY OF THE INVENTION

According to the present invention, there is provided a method of producing sealed end stringers for sliding clasp fasteners from a pair of stringer tapes each provided on one edge thereof with a row of fastening elements, the method comprising the steps of so arranging the tapes that the rows of fastening elements are disposed opposite each other, welding to the tapes a plurality of spaced apart pairs of plastics strands extending transversely of the tapes, severing the strands between the tapes, forming on said edges of the tapes a plurality of plastics guide members each connected to a respective one of the severed portions of alternate ones of the strands to extend away from the respectively adjacent one of the other strands, and severing the tapes between the strands of each pair.

By this method, continuous lengths of stringer tape may be furnished at predetermined intervals — corresponding to the desired lengths of the sliding clasp fasteners — with end pieces and guide members for the stringers of the fasteners, and may then be severed between the strands of each pair of strands to provide completed stringer pairs with ends sealed by the strands. The stringers of each fastener may be fitted with a slider and, on the guide member of one of the stringers, with an open end box member having a slot to receive the guide member of the other stringer. The end pieces at the ends of the stringers remote from the guide members may, depending on their final shape, limit travel of the slider along the stringers, and the sealed ends of the stringers may prevent fraying of the tapes.

The strands to be welded to the tapes are preferably of circular cross-section, and for preference each strand is so deformed by the welding step as to be substantially flat in each region thereof overlying the tapes. This may be facilitated if the strands are arranged on respective surface portions of the tapes facing in the same direction, and the strands of each pair may, if desired, be spaced apart to include at least one of the fastening elements of each row therebetween.

To enable those strand portions not connected to the guide members to function as end stops for the sliders of the respective fasteners, it may be expedient during the welding step to so deform one of the strands of each pair where it overlies the tapes as to provide two abutments respectively adjacent the two rows of fastening elements, the guide members then being connected to the other strands of the pairs. These abutments may serve to prevent a slider of conventional construction from accepting such end stops in its guide passages for the fastening elements.

The tapes may be so arranged that their rows of fastening elements are spaced apart in the region of the strands, and in this case the strands may be severed in such a manner that their severed portions either are substantially flush with the outward extremities of the fastening elements or else project beyond such extremities. In the latter case, the projecting ends of the strand portions may themselves serve to arrest movement of the slider along the respective fastener. However, if this feature is not required, for example due to provision as aforesaid of abutments to perform the same task, the projecting ends of the strand portions can be suitably trimmed.

The guide members may be conveniently formed by welding strips of plastics material to the rows of fastening elements, and in cases where the fastening elements are also of plastics material, this may be carried out with simultaneous deformation of the fastening elements to which the strips are welded. Alternatively, each guide member may be formed simply by suitably deforming a respective plurality of the fastening elements. As the severed portions of the strands to which the guide members are connected are not required to act as end stops in the completed fastener, any part of these strand portions projecting beyond the outward extremities of the fastening elements may be removed, for example by deformation during the welding of the guide member strips.

Advantageously, ultrasonic welding is employed for joining the pairs of strands and the guide member strips to the stringer tapes and fastening elements.

BRIEF DESCRIPTION OF THE DRAWINGS

The novel features which are considered as characterising the invention are set forth in particular in the appended claims. The invention itself, however, both as to its construction and its method of operation, together with additional objects and advantages thereof, will be best understood from the following detailed description of certain specific embodiments with reference to the accompanying drawings, in which:

DESCRIPTION OF THE PREFERRED EMBODIMENTS

Figure 1:
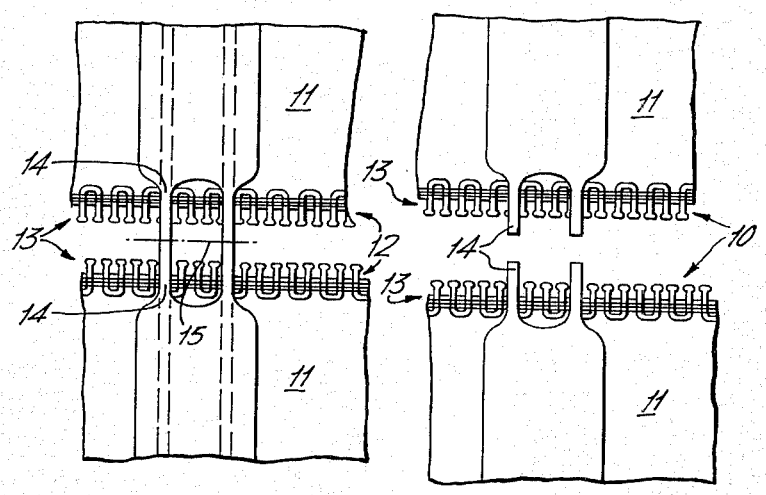
FIG. 1 is a schematic view of two stringers provided with two spaced apart pairs of welded strands, one pair of which has been severed, in accordance with a first embodiment of the invention.
Figure 2:
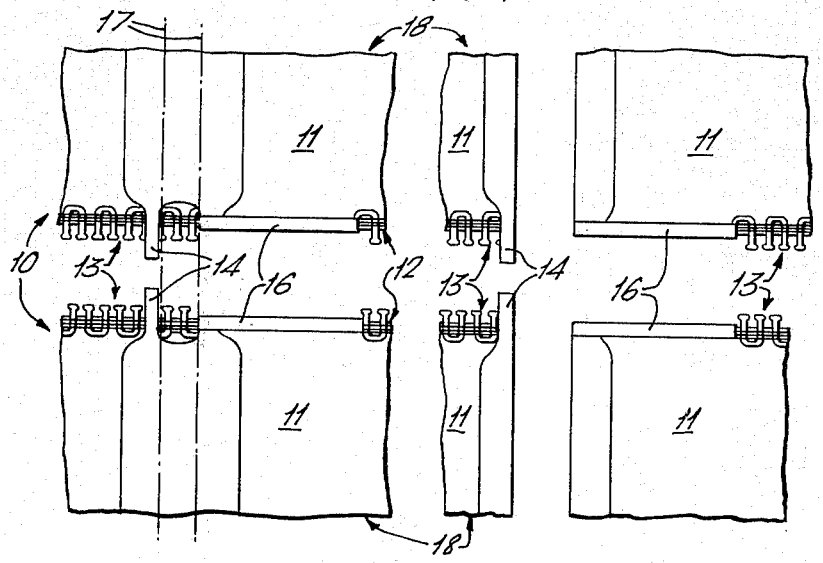
FIG. 2 is a schematic view of the stringers of FIG. 1 provided with the guide members, the tapes being severed between the strands of one of the pairs of strands.

Referring now to FIGS. 1 and 2 of the drawings, there is shown, for the production of sealed end stringers for a sliding clasp fastener, two stringers 10 comprising a pair of flexible textile tapes 11, which are respectively provided on two edges 12 thereof with two rows of interengageable fastening elements 13 and which are arranged so that the rows of fastening elements face each other. In the described embodiments of the invention, the two rows of fastening elements 13 are formed from two continuous thermoplastics filaments shaped so that individual ones of the fastening elements are arranged one behind the other and are joined on one side of the respective tape to the preceding element and on the other side to the succeeding element. The filaments are sewn to the tapes.

As shown in FIG. 1, spaced apart pairs of circular sections strands 14 of thermoplastics material are arranged on the same side of the tapes to extend transversely thereof, the spacing of the strand pairs being selected so that the distance between adjacent strands of adjacent pairs approximately represents the desired length of the finished sealed end stringers. In addition, the strands of each pair are spaced apart to include therebetween three of the fastening elements 13 of each row, and in the region of each pair of strands the tapes are arranged so that their edges 12, and thus the rows of fastening elements, are spaced apart by an amount chosen with reference to criteria that will be subsequently explained.

The strands 14 are then welded to the tapes 11 by an ultrasonic welding process carried out with sufficient pressure to flatten the strands onto the tapes and to seal the sewing threads for the fastening element filaments, the pressure being so applied that the cross-section of the strands outwardly of the edges 12 is substantially unaffected.

As shown in FIG. 1, the strands are then severed on a line 15 between the tapes so that the severed portions of the strands all project to substantially the same extent beyond the outward extremities of the respectively adjacent fastening elements 13. The extent of such projection is determined by the spacing of the tapes prior to welding of the strands, and this spacing is chosen in accordance with the desired characteristics of the finished sealed end stringers and of the slider to be mounted on the stringers, in particular the requirement for the projecting ends of the severed portions of alternate strands to function as end stops limiting the travel of the slider. The extent to which the ends of the strand portions project beyond the fastening elements may, however, be modified by any subsequent deforming or cutting step.

Referring now to FIG. 2, the tapes 11 are next provided on their edges 12 with longitudinally extending guide members 16 of thermoplastics material, each of the guide members being connected to a respective one of the severed portions of alternate ones of the strands 14 to extend away from the respectively adjacent one of the other strands. Each of the guide members 16 is formed by ultrasonically welding a strip of thermoplastics material to the strand portion to which it is to be connected and to an adjacent plurality of the fastening elements 13, the welding being carried out with sufficient pressure to so deform the fastening elements and projecting end of the strand portion as to produce an elongate member of generally rectangular cross-section projecting from the edge 12 of the respective tape a lesser distance than the undeformed fastening elements of that tape.

Finally, as shown in FIG. 2, the tapes and the fastening element filaments are severed on two lines 17 between the strands of each strand pair to produce pairs of finished stringer lengths 18 each equipped with sealed ends and with an end stop at one end and a guide member at the other end.

In subsequent production of a sliding clasp fastener incorporating a pair of such sealed end stringers, one of the stringers may be fitted with a slider and the guide member of that stringer may be utilized as a support for an open end box member mounted to the stringer, the box member having a slot for reception of the guide member of the other stringer.

Figure 3:
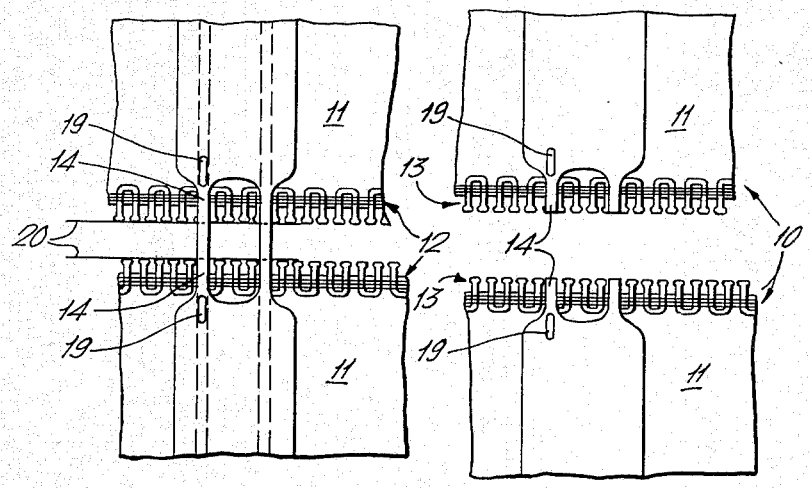
FIG. 3 is a view, similar to FIG. 1, of two stringers provided with two spaced apart pairs of welded strands in accordance with a second embodiment of the invention.

In the case of the embodiment shown in FIG. 3, in which features corresponding to those of FIG. 1 are identified by the same reference numerals, one of the strands of each pair of strands 14 is deformed during welding to the tapes 11 to provide two abutments 19, which project above the tape surfaces to which such strand is welded and which are disposed respectively adjacent to the two rows of fastening elements 13. These abutments serve to limit the travel of a slider in a sliding clasp fastener incorporating the stringers 10 in finished form, the abutments being arranged to engage the outer walls of guide passages provided in the slider for the fastening elements.

The strands 14 may then be severed on two lines 20 so that the severed portions of the strands are substantially flush with the outward extremities of the respectively adjacent fastening elements 13. Alternatively, the strands may be simply divided on a single line, for example the line 15 shown in FIG. 1, and then if so desired the projecting ends of the severed portions of either or both strands of each pair may be trimmed off in a subsequent cutting step.

Thereafter, the guide members are formed on the edges 12 of the tapes and the tapes and fastening element filaments are severed substantially as described in connection with FIG. 2. As a final step, however, the strand portions provided with the abutments 19 may be trimmed off so as to be below the level of the outward extremities of the respectively adjacent fastening elements.

It will be readily apparent that aspects of the method according to the invention for producing sealed end stringers may be modified within the spirit and scope of the invention, and that the step of severing the tapes may be performed in a different order to that described.

We claim:

1. A method of producing sealed end stringers for sliding clasp fasteners from a pair of stringer tapes each provided on one edge thereof with a row of fastening elements, the method comprising the steps of so arranging the tapes that the rows of fastening elements are disposed opposite each other, welding to the tapes a plurality of spaced apart pairs of plastics strands extending transversely of the tapes, severing said strands between the tapes, forming on said edges of the tapes a plurality of plastics guide members each connected to a respective one of the severed portions of alternate ones of said strands to extend away from the respectively adjacent one of the other ones of said strands, and severing the tapes between the strands of each pair of said strands.

2. A method as defined in claim 1, wherein said strands are arranged on respective surface portions of the tapes facing in the same direction.

3. A method as defined in claim 1, wherein the strands of each pair of said strands are spaced apart to include at least one of the fastening elements of each row therebetween.

4. A method as defined in claim 1, wherein each of said strands is of circular cross-section.

5. A method as defined in claim 1, wherein the welding step comprises deforming each of said strands to be substantially flat in at least part of each region thereof overlying the tapes.

6. A method as defined in claim 1, wherein the welding step comprises so deforming one of the strands of each pair of said strands where said one strand overlies the tapes as to provide two abutments disposed respectively adjacent the two rows of fastening elements, said guide members being connected to the other strands of the pairs of said strands.

7. A method as defined in claim 1, wherein the tapes are so arranged that the rows of fastening elements are spaced apart in the region of said strands.

8. A method as defined in claim 1, wherein the tapes are so arranged that the rows of fastening elements are spaced apart in the region of said strands, and the step of severing said strands is so carried out that the severed portions of said strands project beyond the outward extremities of the fastening elements.

9. A method as defined in claim 7, wherein the tapes are so arranged that the rows of fastening elements are spaced apart in the region of said strands, and the step of severing said strands is so carried out that the severed portions of said strands are substantially flush with the outward extremities of the fastening elements.

10. A method as defined in claim 1, wherein the step of forming said guide members comprises welding strips of plastics materials to the rows of fastening elements.

11. A method as defined in claim 10, wherein said strands and the strips to form said guide members are welded ultrasonically.

12. A method as defined in claim 1, wherein the step of forming said guide members comprises deforming, for each of said guide members, a respective plurality of the fastening elements.

13. A pair of sealed end stringers for a sliding clasp fastener, the sealed end stringers being produced by the method as defined in claim 1.

14. A sliding clasp fastener comprising a pair of sealed end stringers produced by the method as defined in claim 1.

* * * * *